US005511332A

United States Patent [19]

Sturkie et al.

[11] Patent Number: 5,511,332

[45] Date of Patent: Apr. 30, 1996

[54] CORNICE ASSEMBLY

[75] Inventors: Charles B. Sturkie, Jefferson; David J. Stabile, Atlanta, both of Ga.

[73] Assignee: Miller/Zell, Inc., Atlanta, Ga.

[21] Appl. No.: 299,538

[22] Filed: Sep. 1, 1994

[51] Int. Cl.[6] ..... G09F 3/18

[52] U.S. Cl. ..... 40/642; 248/223.41

[58] Field of Search ..... 40/642, 649, 611, 40/618, 622; 248/223.4; 312/263, 265.5; 108/27

[56] References Cited

U.S. PATENT DOCUMENTS

| | | | |
|---|---|---|---|
| 2,936,904 | 5/1958 | Streater | 40/649 X |
| 4,319,731 | 3/1982 | Pfeifer | 248/223.4 |
| 4,531,311 | 7/1985 | Howard et al. | 40/649 |
| 4,682,430 | 7/1987 | Ramsay | 40/649 X |
| 4,858,413 | 8/1989 | Grushka | 108/27 |
| 5,044,104 | 9/1991 | Hoppendietzel | 40/649 X |
| 5,197,215 | 3/1993 | Torsleff | 40/642 |
| 5,440,857 | 8/1995 | Shanok et al. | 108/27 X |

*Primary Examiner*—Peter M. Cuomo
*Assistant Examiner*—James O. Hansen
*Attorney, Agent, or Firm*—Hopkins & Thomas

[57] ABSTRACT

A decorative cornice assembly to be mounted onto in-store product display fixtures, is disclosed. The various embodiments are modular, and readily can be assembled and installed in store environments. The assemblies support and display graphics displays, such as advertising and informational headpieces. The assemblies are designed to be used in association either with one sided or wall mounted display fixtures or with two sided fixtures. Decorative moldings can be incorporated to complete an attractive visual appearance to the cornice assembly.

21 Claims, 4 Drawing Sheets

CORNICE ASSEMBLY

FIELD OF THE INVENTION

This invention relates to a decorative cornice assembly which also serves as a graphics display support unit. The cornice assembly is especially designed to mount onto an in-store display fixture, such as point-of-sale merchandise shelving or gondolas. The supporting fixture can be either free-standing or wall mounted units which include shelves or other means for displaying merchandise. The cornice assembly of the present invention is readily installed onto and removed from common point-of-sale display units, and is designed to be assembled on presently existing in-store units. The cornice assembly preferably is mounted along the uppermost portion of the display unit, above the merchandise, although it also can be mounted at any other vertical location on the display unit above the floor. All of the embodiments of the present invention permit an elongate, planar graphics display to be inserted into or removed from the cornice assembly.

BACKGROUND OF THE INVENTION

Point-of-sale or point-of-purchase, in-store display fixtures are commonly used as a way of presenting merchandise for display to prospective purchasers. Typically, such display fixtures or display units are comprised of vertically oriented standards or uprights supported by a base member and braces. The uprights ordinarily support, in cantilever fashion, shelves or horizontally disposed shelf supports. Some known display units include a substantially rectangular grid or framework which not only structurally supports the unit, but also carries shelves.

It also is common in retail stores, such as mass merchandising outlets and grocery stores, to have double-sided display units aligned in spaced relationship to form aisles between successive units. The display units support shelves from opposing sides of the uprights to form double-sided displays. Separating boards, such as peg boards, typically are disposed between the uprights, in order to separate opposing shelves. These double-sided, in-store display units typically have a similar structural steel support frame as the single-sided or wall mounted display fixtures.

Merchandisers predominately utilize in-store advertizing or informational displays to promote their products. Such promotional items take the form of graphic displays, such as banners, headpieces and other printed materials, suspended by various means either adjacent to or attached to the product display units. Often these graphic display units are not readily assembled "in-store" or are self-standing units which can interfere both with customer flow or with the display of the products themselves. Additionally, these known promotional displays typically are made for a single graphics item only, and must be discarded or removed when the new material or promotional item is advertised. It is thus believed that a need exists for a graphics display unit, such as the modular cornice assembly of the present invention, which readily can be assembled in-store and mounted onto existing product display fixtures, so as to be positioned for maximum customer viewing and minimum interference with customer flow and product display.

SUMMARY OF THE INVENTION

Briefly described, the invention comprises a cornice assembly especially adapted to be mounted to an in-store, point-of-purchase display fixture. The cornice assembly is modular, capable of being selectively installed in sections, as needed, and is readily assembled in the merchandising outlet. One embodiment includes a graphics display mounting plate which is elongate and capable of accepting a substantially planar graphics display along one side. The graphics display is slidably received between two inwardly directed, opposed guide channels of the mounting plate. The opposite side of the mounting plate includes retainer means for cooperating with an adaptor which connects the mounting plate to the in-store display fixture. The cornice assembly, for example, is installed onto the display fixture by being attached along the upper portion of the display fixture, above the merchandise or products. The graphics display is removably held by the cornice assembly, presenting the intended advertising or informational message to perspective customers. The graphics display readily can be removed and replaced another graphics display; at the merchandiser's discretion.

The cornice assembly generally is elongate, designed to extend along the entire length of the display fixture, if desired. If a substantially long cornice assembly is utilized, such as for example, over two to three feet in length, several mounting adaptors are disposed in spaced relationship along the length of the cornice assembly to provide for the necessary support. This embodiment is intended for use primarily with one-sided, or wall mounted display fixtures.

In another embodiment similar to that described above, a facia plate is placed into engagement with the mounting plate. The facia plate is designed to support both a decorative molding as well as to hold the graphics display. This embodiment of the present invention provides a more decorative appearance, but is also in modular form, allowing for discrete sections to be installed side by side or at angles to one another.

Yet another embodiment of the present invention is designed for double-sided display fixtures, such as those having opposed shelves. In this embodiment, the cornice assembly is attached to the vertical standards or uprights of the display fixture at their uppermost ends, and can run the entire length, or just a part thereof, of the fixture. In this embodiment, the facia plate is held in vertical alignment between upstanding junction supports. Each side of the facia plate is designed to receive a decorative molding as well as to releasably retain the graphics display. On all embodiments of the present invention which utilize decorative molding, the molding is especially designed to cooperate with the molding retaining means, to provide or define a channel for the slidable engagement of the graphics display between the molding and the facia plate.

The invention also includes elements for joining sections of the cornice assemblies which are mounted to display fixtures and disposed at angled relationship to one another.

Accordingly, it is an object of the present invention to provide a modular cornice assembly which can be anchored to in-store merchandise display fixtures, and which is adapted to hold an informational or advertised graphics display for customer viewing. The invention also is designed to be readily installed in an in-store environment to existing display fixtures.

It is another object of the invention to provide a cornice assembly capable of receiving decorative moldings of various types, to present a more attractive appearance along with the graphics display. The cornice assembly can be applied to either one-sided or two-sided display fixtures or units. Other objects, features and advantages of the present invention will become apparent upon reading the following specification in conjunction with the accompanying drawing figures.

DETAILED DESCRIPTION OF THE PREFERRED EMBODIMENTS

Figure 1:
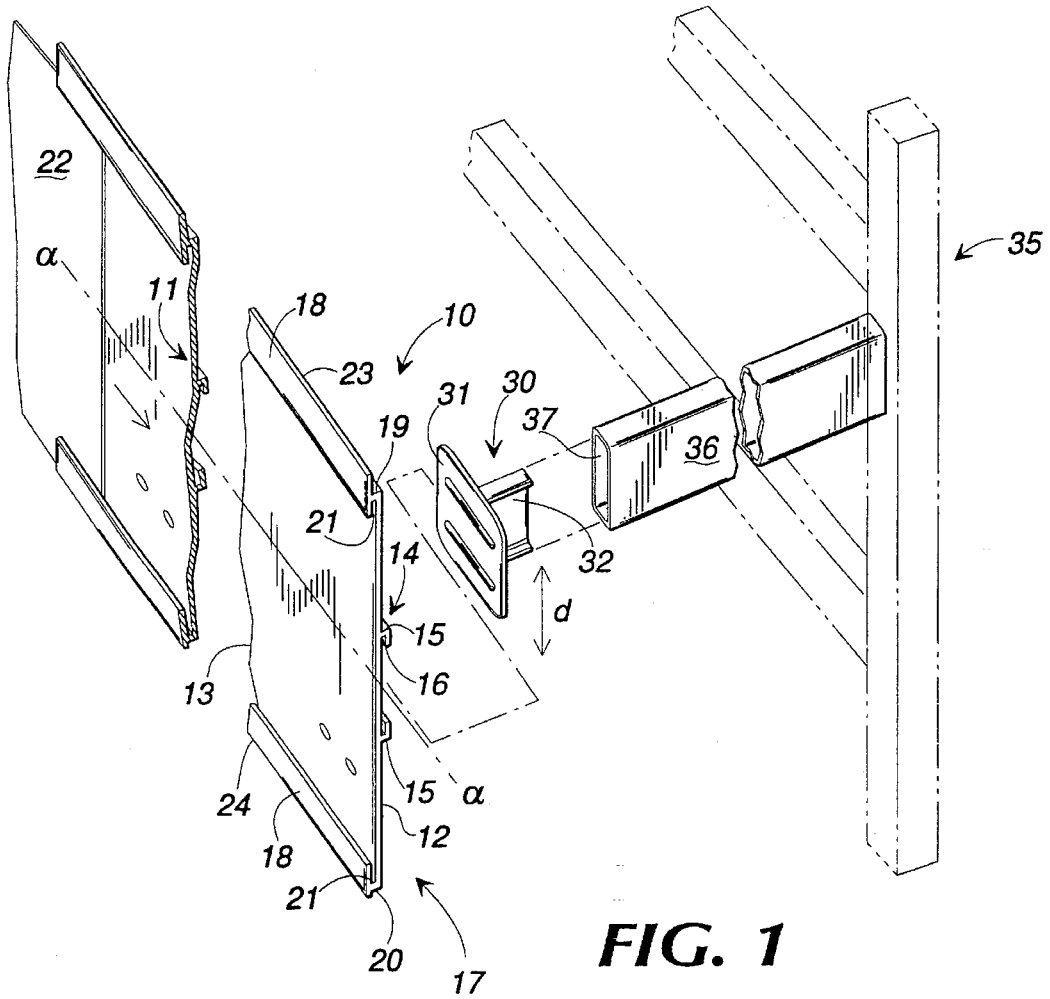
FIG. 1 is an exploded, perspective view of one embodiment of the present invention.

Referring now in detail to the drawing figures, wherein like reference characters denote like parts throughout the several views, FIG. 1 shows one embodiment of the cornice assembly 10 of the present invention. The mounting plate 11 includes a back side surface 12 and a front side surface 13 opposing surface 12. The mounting plate comprises numerous extruded features integral with plate 11. These features include a retainer bracket 14 having inwardly extending guides or flanges 15. Guides 15 are L-shaped, extending outwardly from side 12 to form channels 16 between the inwardly directed, L-shaped portions of guides 15 and the mounting plate back side surface 12. Guides 15 are positioned preferably equidistant from longitudinal axis $\alpha$ of the cornice or valance assembly, although guides 15 alternately can be spaced from one another and be positioned along any axis parallel to axis $\alpha$. Positioning the retainer along the central axis, however, adds to the stability of the invention. The cornice assembly also is extruded to include a graphics display guide assembly 17. Guide assembly 17 similarly includes inwardly directed, L-shaped guides or flanges 18 positioned at the upper edge portion 19 and the lower edge portion 20 of the mounting plate. Similar to the flanges of retainer 14, guides 18 of the graphics display guide assembly are L-shaped and therefore have a portion which is spaced outwardly from their associated side surface 13, to define therebetween longitudinal channel 21. As is described further detail herein, channel 21 is sized of a width to readily receive a substantially flat graphics display or headpiece 22, which is held in the channel by guides 18. An upper flange 23 extends outwardly, opposing the L-shaped leg section of guide 18, as shown in FIG. 1. Similarly, a lower flange 24 also extends outwardly from the lower portion of plate 11 in the opposite direction to flange 23.

A mounting adaptor 30 includes a substantially flat, rectangular support flange 31 which is sized along its vertical dimension d to be slidably engaged in retainer 14, snugly fitting between opposing guides 15. The thickness of support flange 31 closely corresponds to the width of channel 16, so that when the support flange is slidably received within channel 16, the close tolerances of the support flange thickness and channel width ensure that the adaptor and the mounting plate snugly fit together, although being separated by forcibly sliding the adaptor out of retainer 14. The adaptor also includes a connector or plug 32 so as to be in normal relationship to the back surface of support flange 31. Plug 32 either can be rectangular or I-shaped in cross section, and preferably is integrally formed with flange 31 to be a unitary piece, as for example, by being injection molded.

The purpose of adaptor 30 is to securely but releasably attach mounting plate 11 to a display fixture, such as fixture 35. Typically, in-store, point-of-purchase display fixtures will include a vertically disposed frame member with a horizontal bar or shelf support such as bar 36. Bar 36 is made of hollow, rectangular steel or other rigid substance, such as plastic, and defines interior chamber 37, which is also rectangularly shaped and sized to the approximate outer dimensions as those of plug 32. Plug 32, therefore, can be snugly press-fit into chamber 37. In this manner, adaptor 30, and mounting plate 11 attached to the adaptor, are securely held to the display fixture.

Figure 2:
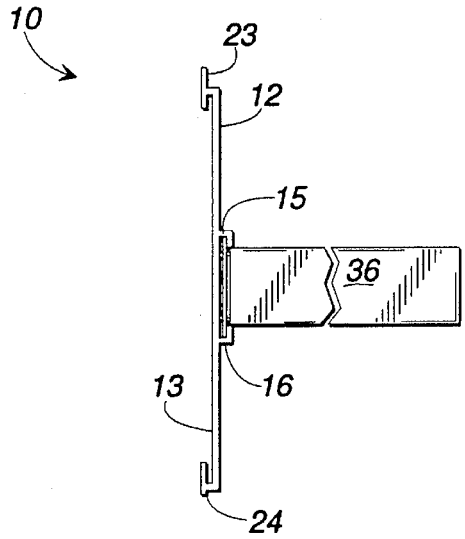
FIG. 2 is a side elevational view of the embodiment of FIG. 1, shown attached to a portion of a display unit.

As shown in FIG. 2, when the cornice assembly is attached to a display fixture, the mounting plate is vertically oriented, with surface 13 facing outwardly away from the display fixture. Although, the cornice assembly shown in FIG. 1 is of a relatively small section and includes only one adaptor 30, in practice the cornice assemblies are elongate in sections of, for example three, four and six feet, and have retainer 14 extending the entire lengths of each section of the modular cornice assembly. Numerous adaptors, therefore, can be slid along retainers 14 to provide support for the mounting plate 11 where needed. Further, many sections of cornice assemblies of the present invention can be mounted together in end-to-end relationship. The specific means or anchor for attaching the mounting plate to the display fixture is disclosed herein for illustrative purposes only. Any of numerous, known methods for attaching the mounting plate to the display fixture, such as by bolts, clips or angle brackets, will function adequately for the purposes of the present invention.

When mounting plate 11 is properly installed, front side 13 projects outwardly toward prospective customers. Any graphics display, such as display 22, which is substantially flat, of a thickness corresponding to the distance between the upper and lower guides, and which is of a length substantially corresponding to the length of the cornice assembly, is positioned between guides 18 by sliding the graphics display along surface 13 within channels 21. If the graphics display is flexible, it can be installed by bending or flexing the graphics display and allowing it to return back into its original position, fitting within channels 21. The cornice assembly 10, therefore, is readily assembled onto its associated display fixture, providing a suitable support for corresponding graphics display.

Figure 3:
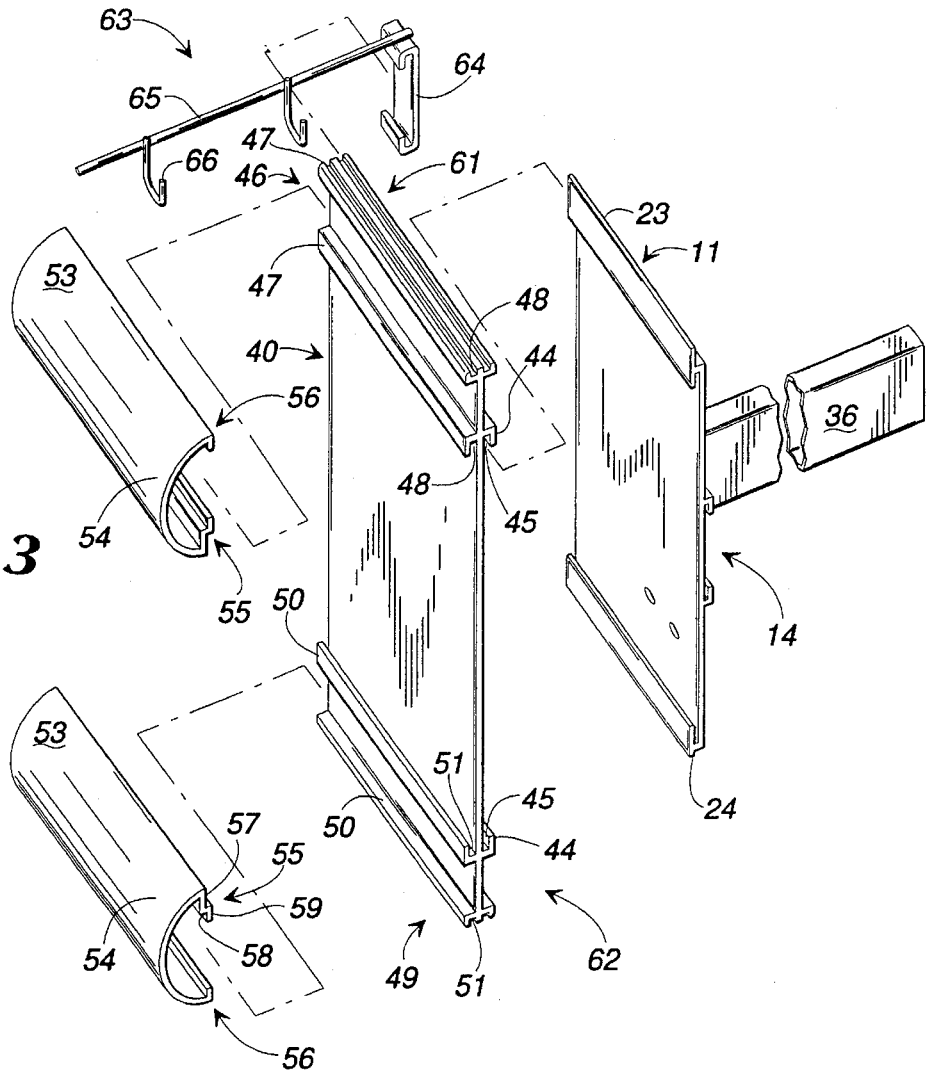
FIG. 3 is an exploded, perspective view of a second embodiment of the present invention.
Figure 4:
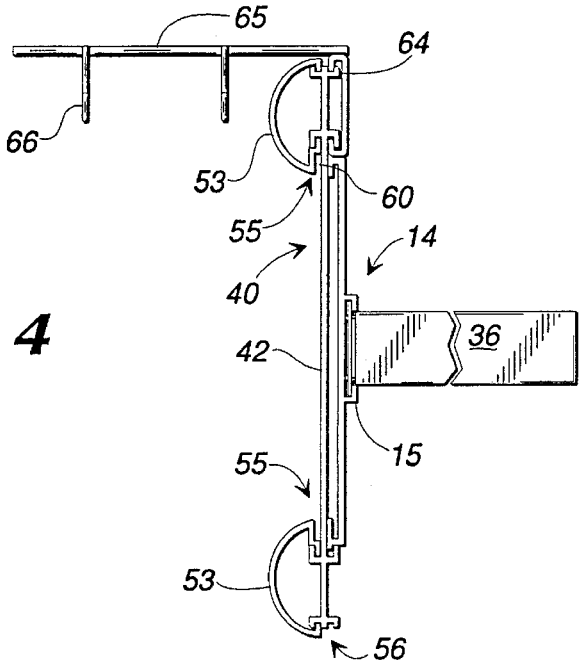
FIG. 4 is a side, elevational view of the embodiment of FIG. 3, shown attached to a portion of a display unit.

A second embodiment of the present invention includes the addition of a facia plate, which performs the dual functions both of supporting the graphics display and of supporting decorative moldings. This embodiment includes each of the elements discussed above, and also includes a facia plate 40 designed to be attached onto mounting plate 11. The facia plate also is preferably an extruded member comprised of a rigid plastic substance such as polystyrene. The facia plate has numerous, integrally molded features, and is substantially planar having a first or back side surface 41 and a second or front side surface 42. A retainer bracket assembly 43 is formed along the back side of the facia plate, and includes inwardly extending, L-shaped brackets or guide flanges 44. Guide brackets 44 extend outwardly from back side surface 41, as shown in FIG. 3, to each define elongate channel 45. Retainer assembly 43, therefore, includes an upper channel 45 and lower channel 45. These channels are identically sized to snugly receive either upper flange 23 or lower flange 24, respectively. Since mounting plate 11 is comprised of polystyrene, it is relatively stiff, but can be bent along its central longitudinal axis to be "snap fit" in retainer assembly 43.

Typically, upper flange 23 is inserted into upper channel 45, and the mounting plate is flexed or bent along its longitudinal axis so that lower flange 24 can pass over lower guide bracket 44. When mounting plate 11 is released, it returns to its original, planar shape thus snapping lower flange 24 into lower guide channel Alternately, mounting plate 11 can slidably engage facia plate 40 by sliding flanges 23 and 24 longitudinally into upper and lower channels 45, respectively. The facia plate, therefore, is supported by mounting plate 11 so that the front side surface of the facia plate projects forwardly toward prospective customers.

Integrally molded on the front side of the facia plate is an upper decorative molding retainer 46, which is comprised of two L-shaped, outwardly extending flanges 47. Outwardly directed flanges 47 define elongate channels 48. The front side of the facia plate also defines lower decorative retainer molding 49, also comprised of outwardly directed, L-shaped flanges 50 defining elongate channels 51. These channels are sized to slidably engage identical decorative moldings 53. Moldings 53 are decorative moldings intended to impart visually attractive characteristics to the cornice assembly. For the purposes of illustrating the present invention, the decorative moldings shown are "bull nosed" moldings having a curved front edge 54 and inwardly directed rear edge portions 55 and 56.

As shown in FIG. 3, step edge portion 55 includes downwardly extending edge 57, horizontally extending edge 58 and downwardly extending edge 59, to form stepped-shaped edge portion 55. Edge portion 56 merely extends inwardly toward edge portion 55. The decorative moldings are slidably received on upper retainer 46 and lower retainer 49, respectively, and are thereby releasably retained on the front surface of facia plate 40. Otherwise, the decorative moldings can be flexed or bent to clear retainers 46 and 49 and then released and allowed to snap into place between retainers 46 and 49 as the moldings return to their original shape. The stepped edge portion 55 of each decorative molding is directed inwardly so that a channel 60 is defined between each molding and the front surface 42 of the facia plate. Channel 60 provides a space between the decorative molding and the front surface of the facia plate to receive a substantially flat graphics display such as headpiece 22. The moldings 53, therefore, accomplish the dual purpose of both providing an aesthetic component to the cornice assembly and retaining the graphics display in its proper position.

The back side surface 41 of the facia plate also defines integrally molded rear retainers 61 and 62 which are identical in structure to retainers 46 and 49, respectively. Support assembly 63 is designed to be received on, for example, upper, rear retainer 61 in order to suspend additional products or informational literature. Hook support 63 includes C-shaped hanger bracket 64 which is sized to slidably engage retainer 61. Extending outwardly from bracket 64 is hook support 65 which includes downwardly extending hooks 66.

Each of the above-referenced embodiments is intended for use in "one sided" displays or gondolas. That is, the support member for the graphics display, whether it be the mounting plate or the facia plate, is intended in the above-referenced embodiments to support the graphics display along one side only. These embodiments ideally are suited for wall mounted display fixtures or one-sided floor standing racks.

Figure 5:
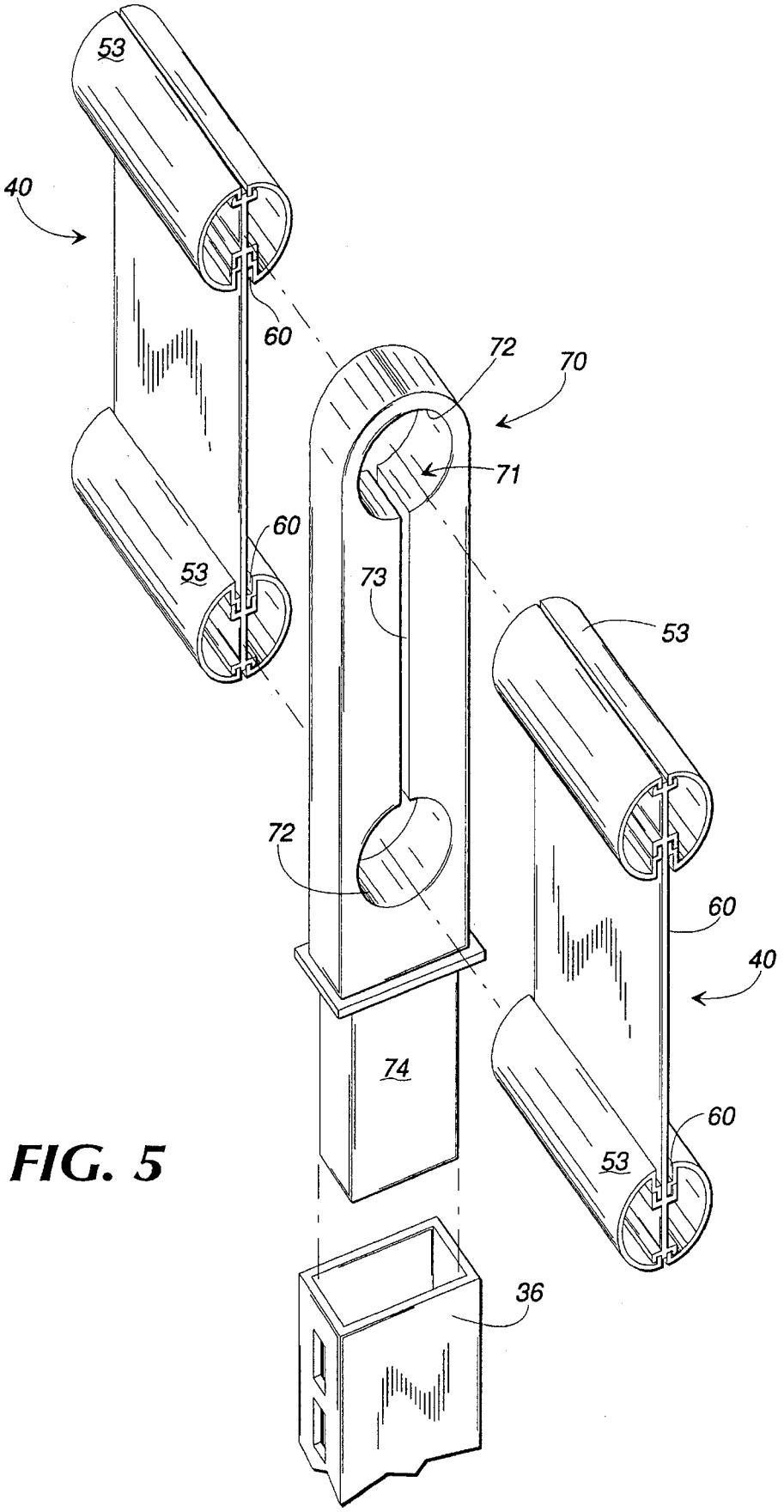
FIG. 5 is an exploded, perspective view of a third embodiment of the present invention.

As stated, however, merchandising outlets also use double-sided display fixtures, such as double sided shelving spaced at intervals to define aisles between successive fixtures. In this application, a double sided cornice assembly can be used. FIG. 5 shows a double sided cornice assembly having the identical facia plate 40 as discussed above with respect to the prior embodiment. This embodiment also includes the same decorative moldings 53. All elements of facia plate 40 and molding 53 cooperate and perform the identical functions in this embodiment, as discussed above with respect to the prior embodiment. In the present embodiment, however, the facia plate is not supported by the mounting plate. Rather, the facia plate is supported by a junction adaptor 70. Junction adaptor 70 is elongate, preferably formed of molded plastic, and defines therethrough barbell shaped cavity 71. Cavity 71 includes upper and lower, round cavity sections 72 extending through the junction adaptor and elongate cavity or channel 73, connecting upper and lower cavities 72. The diameters of round cavity sections 72 are sized to receive two abutting curved moldings 53 which together essentially form a circle in cross section, as shown in FIG. 5. Channel 73 is sized to freely receive the facia plate 40. If moldings having a different shape than bull nosed moldings 53 are used, upper and lower cavities 72 must be defined to be a shape to accommodate such moldings.

Junction adaptor 70 includes downwardly extending connecting plug 74. Connecting plug 74 functions identically to connecting or plug 32, and is sized to fit snugly into bar 36. The only difference between the function of the connecting plug of this embodiment and that of the prior embodiments, is that the connecting plug with the present embodiment is intended to fit into a vertical standard or upright of the display fixture 36, rather than a horizontal display fixture frame member. As shown in FIG. 5, the decorative moldings slidably engage each side of the facia plate to form a two-sided cornice assembly. Two such assemblies are supported or held in vertical display position by inserting the moldings and the facia plate into the cavity of the junction adaptor 70. Each facia plate and its associated moldings are inserted into the cavity of the injunction adaptor from either side until they abut. In this manner, the junction adaptor will hold the two juxtaposed cornice assemblies. Additional junction adaptors are attached to the display fixtures 35 at the free ends of the respective cornice assembly, in order to support each end of the each assembly. This embodiment forms a two-sided cornice assembly, with the graphics display being inserted into channels 60 on each side of the facia plate.

It should also be appreciated that the above-referenced invention, and each of its embodiments, is modular. That is, any number of lengths of the assembly can be connected together along the entire length of the display fixture. The only requirement is that the assembly be mounted to the display fixture at sufficient locations to properly support the cornice assembly.

Figure 6:
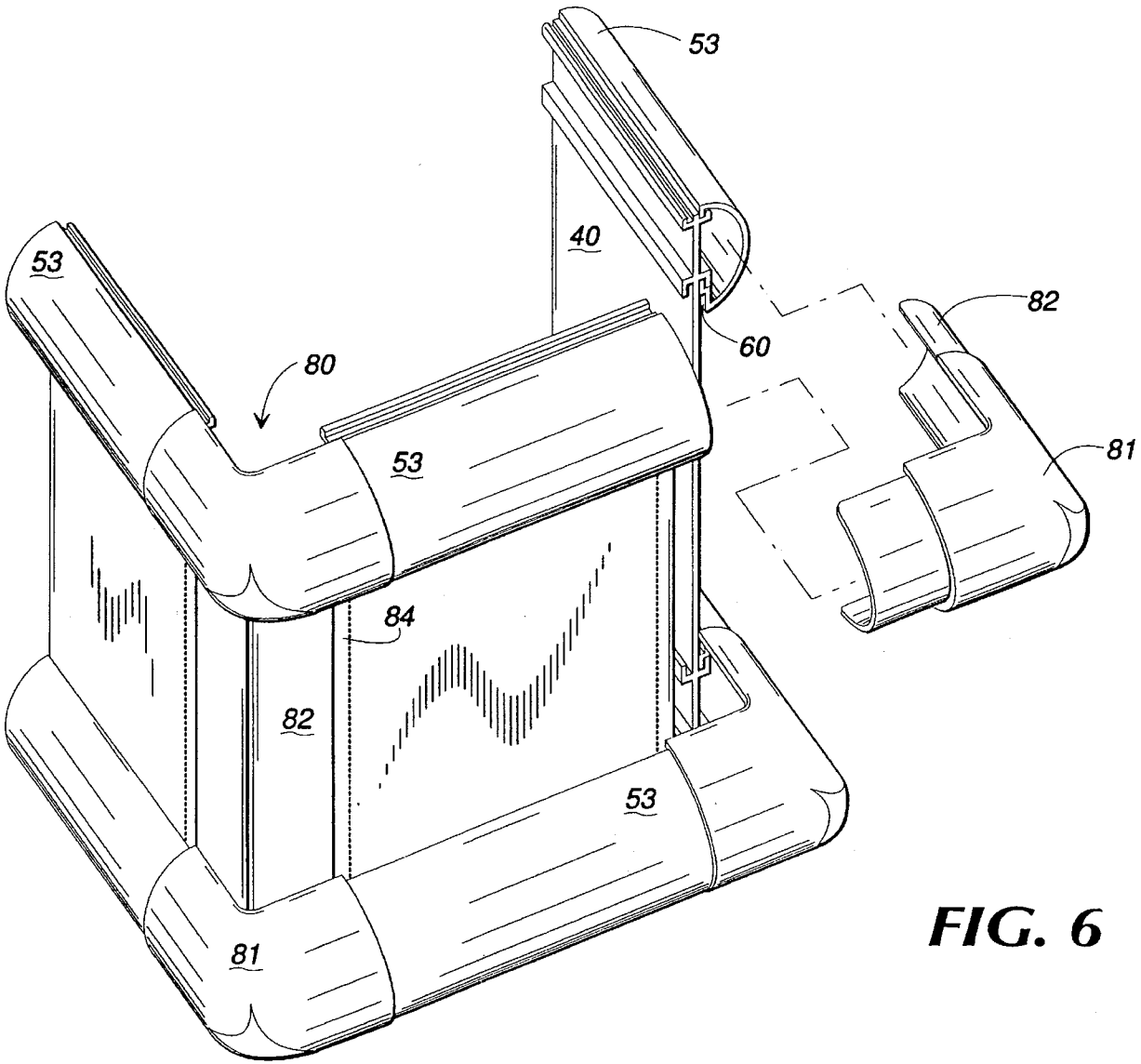
FIG. 6 is a partially exploded, perspective view of a corner junction attachment of the present invention.

FIG. 6 depicts the one-sided cornice assembly of the second embodiment, disclosing corner fittings. For purposes of illustration, the embodiment in FIG. 6 does not show the mounting plate and its associated adaptors or the supporting display fixture. In the embodiment shown in FIG. 6, the moldings 53 are attached to the front of the facia plate only. In this embodiment, however, the display fixture is arranged so that the facia plate and their associated moldings join at right angles. To support these right angle cornice assemblies, as well for improved visual appearance, a corner fitting assembly 80 is provided. Assembly 80 includes internal corner fittings 81 and upright corner cover 82. Internal corner fittings 81 are L-shaped, having the same outer shape as curved molding 53. Fittings 81 include at each end concentric flanges 82 of a reduced curved shape than the decorative moldings, that are adapted to be received by internal slidable engagement with moldings 53. Flanges 81 must be shaped the same as moldings 53 to accomplish snug, internal slidable engagement therewith. To complete corner assembly 80, upright corner covers 82 are provided. Covers 82 include flange 84 which engages channels 60 of the abutting facia plate 40 to secure cover 82 to two angled facia plates, and join the facia plates together. Alternatively or in addition, covers 82 can be attached to the back side surface of the facia plate by, for example, double sided tape, for secure mounting. Cover 82 also is L-shaped at any appropriate angle, in this embodiment shown as 90°, so that the front surface of the facia plate smoothly continues around the angle.

Also as discussed above, many variations may be had with respect to the elements of the disclosed cornice assemblies. Therefore, while the invention has been disclosed in preferred forms only, it will be obvious to those skilled in the art that many additions, deletions and modifications can be made therein without departing from the spirit and the scope of the invention as set forth in the following claims.

What is claimed is:

1. A cornice assembly for holding a graphics display for a display fixture, comprising a bar defining an interior chamber; an adaptor having a plug sized and shaped to press-fit into said interior chamber for releasably attaching said adaptor to said display fixture and a support flange mounted to said plug; and a mounting plate having a first side and a second side, said first side including retainer means for releasably attaching said mounting plate to said adaptor by cooperation with said support flange, and said second side opposing said first side and including a guide assembly, said guide assembly inclosing opposed inwardly directed graphics display guide channels adapted to slidably receive and releasably retain said graphics display.

2. The cornice assembly of claim 1, said adaptor being T-shaped, and said support flange having an inner side and an outer side, said plug being mounted to said inner side in normal relationship to said inner side.

3. The cornice assembly of claim 1, said mounting plate being substantially flat, said retainer means comprising opposed, inwardly directed support flange guide channels adapted to receive and releasably retain said support flange.

4. The cornice assembly of claim 1, said adaptor being T-shaped, and said support flange having an inner side and an outer side, said plug being mounted to said inner side in normal relationship to said inner side and said mounting plate being substantially flat, said retainer means comprising opposed, inwardly directed support flange guide channels adapted to receive and releasably retain said support flange.

5. The cornice assembly of claim 4, said support flange being substantially planar and rectangular for slidable engagement with said retainer means, and said mounting plate being substantially planar and elongate.

6. A cornice assembly for holding a graphics display for a display fixture, comprising an adaptor, a mounting plate attached to said adaptor, a facia plate having an upper edge portion and lower edge portion, said facia plate releasably attached to said mounting plate, a first decorative molding releasably attached to said upper edge portion, a second decorative molding releasably attached to said lower edge portion, and said facia plate including guide means for releasably retaining said graphics display.

7. The cornice assembly of claim 6, said adaptor having mounting means for mounting said adaptor and support means for supporting said mounting plate.

8. The cornice assembly of claim 6, said mounting plate having a first side and a second side opposing said first side, means disposed on said first side for securing said adaptor to said first side and a facia plate attachment means attached to said second side for attaching said facia plate to said mounting plate.

9. The cornice assembly of claim 8, said facia plate attachment means comprising two spaced, outwardly directed flanges.

10. The cornice assembly of claim 6, said facia plate having a first side and a second side, first retainer means attached to said first side for releasably attaching said facia plate to said mounting plate, second retainer means attached to said second side for releasably attaching said first decorative molding to said second side.

11. The cornice assembly of claim 10, said second retainer means also for releasably attaching said graphics display to said facia plate.

12. The cornice assembly of claim 10, and third retainer means attached to said second side for releasably attaching said second decorative molding to said second side.

13. The cornice assembly of claim 12, said third retainer means also for releasably attaching said graphics display to said facia plate.

14. The cornice assembly of claim 6, said mounting plate being slidably engageable with said adaptor and said facia plate being slidably engageable with said mounting plate.

15. The cornice assembly of claim 6, and corner assembly means attached to said cornice assembly for connecting two cornice assemblies angularly disposed to one another.

16. A cornice assembly for holding a graphics display for a display fixture, comprising an adaptor, a mounting plate attached to said adaptor, a facia plate having an upper edge portion and a lower edge portion and having a first side and a second side, first retainer means attached to said first side for releasably attaching said facia plate to said mounting plate, a first decorative molding attached to said upper edge portion, second retainer means attached to said second side for releasably attaching said first decorative molding to said second side, a second decorative molding attached to said lower edge portion, and said facia plate including guide means for releasably retaining said graphics display.

17. The cornice assembly of claim 16, said second retainer means also for releasably attaching said graphics display to said facia plate.

18. The cornice assembly of claim 16, and third retainer means attached to said second side for releasably attaching said second decorative molding to said second side.

19. The cornice assembly of claim 18, said third retainer means also for releasably attaching said graphics display to said facia plate.

20. The cornice assembly of claim 16, said mounting plate being slidably engageable with said adaptor and said facia plate being slidably engageable with said mounting plate.

21. A cornice assembly for holding a graphics display for a display fixture, comprising an adaptor, a mounting plate attached to said adaptor, a facia plate having an upper edge portion and lower edge portion, said facia plate releasably attached to said mounting plate, a first decorative molding attached to said upper edge portion, a second decorative molding attached to said lower edge portion, said facia plate including guide means for releasably retaining said graphics display, and corner assembly means attached to said cornice assembly for connecting two cornice assemblies angularly disposed to one another.

* * * * *